US008240051B2

(12) United States Patent
Fedock et al.

(10) Patent No.: US 8,240,051 B2
(45) Date of Patent: Aug. 14, 2012

(54) METHOD FOR ERECTION OF A SOLAR RECEIVER AND SUPPORT TOWER

(75) Inventors: Dennis S. Fedock, Marshallville, OH (US); Joe C. Roudebush, Uniontown, OH (US); Thomas J. Studer, Canal Fulton, OH (US)

(73) Assignee: Babcock & Wilcox Power Generation Group, Inc.

( * ) Notice: Subject to any disclaimer, the term of this patent is extended or adjusted under 35 U.S.C. 154(b) by 379 days.

(21) Appl. No.: 12/435,062

(22) Filed: May 4, 2009

(65) Prior Publication Data

US 2009/0276993 A1 Nov. 12, 2009

Related U.S. Application Data

(60) Provisional application No. 61/051,171, filed on May 7, 2008.

(51) Int. Cl.
*E04H 12/34* (2006.01)
*E04H 12/10* (2006.01)

(52) U.S. Cl. ..... 29/890.033; 29/429; 29/897.31; 52/651.05; 52/745.18

(58) Field of Classification Search ..... 29/429, 29/897.3, 897.31, 897.312, 469, 890.033; 52/745.17, 745.18, 651.01–651.09; 254/93 R, 254/126, 93 L
See application file for complete search history.

(56) References Cited

U.S. PATENT DOCUMENTS

| | | | | | |
|---|---|---|---|---|---|
| 3,211,427 | A | * | 10/1965 | Bristow, Jr. | 254/89 H |
| 3,213,575 | A | * | 10/1965 | Boczek | 52/123.1 |
| 3,894,635 | A | * | 7/1975 | Reich | 212/176 |
| 3,924,604 | A | * | 12/1975 | Anderson | 126/606 |
| 4,013,885 | A | * | 3/1977 | Blitz | 250/203.4 |
| 4,028,792 | A | * | 6/1977 | Tax et al. | 29/431 |
| 4,125,193 | A | * | 11/1978 | Matsumoto | 212/203 |
| 4,196,814 | A | * | 4/1980 | Reich | 212/204 |
| 4,274,542 | A | * | 6/1981 | Barclay | 212/270 |
| 5,263,835 | A | * | 11/1993 | Schmidt | 425/64 |
| 5,983,634 | A | * | 11/1999 | Drucker | 60/398 |
| 6,868,646 | B1 | * | 3/2005 | Perina | 52/745.17 |
| 7,115,851 | B2 | * | 10/2006 | Zhang | 250/203.4 |
| 7,690,377 | B2 | * | 4/2010 | Goldman et al. | 126/655 |
| 2003/0213765 | A1 | * | 11/2003 | St-Germain | 212/294 |
| 2010/0044330 | A1 | * | 2/2010 | Vorhies et al. | 212/175 |
| 2010/0170188 | A1 | * | 7/2010 | Zilmer et al. | 52/745.17 |

FOREIGN PATENT DOCUMENTS

| | | | | |
|---|---|---|---|---|
| JP | 03021777 | A | * | 1/1991 |
| JP | 08311818 | A | * | 11/1996 |
| JP | 2006077456 | A | * | 3/2006 |
| SU | 831714 | B | * | 5/1981 |
| SU | 1126530 | A | * | 11/1984 |

OTHER PUBLICATIONS

Farret, Felix A.; Simões, M. Godoy (2006). Integration of Alternative Sources of Energy.. John Wiley & Sons. Online version available at: http://www.knovel.com/web/portal/browse/display?_EXT_KNOVEL_DISPLAY_bookid=2443&VerticalID=0.*

* cited by examiner

*Primary Examiner* — David Bryant
*Assistant Examiner* — Jason L Vaughan
(74) *Attorney, Agent, or Firm* — Eric Marich

(57) ABSTRACT

An erection method for a solar receiver and support tower provides a climbing assembly on the support tower to raise the solar receiver to its final elevation by progressively jacking and installing support tower sections to erect the tower and support the solar receiver.

6 Claims, 8 Drawing Sheets

METHOD FOR ERECTION OF A SOLAR RECEIVER AND SUPPORT TOWER

CROSS-REFERENCE TO RELATED APPLICATION

The present invention claims priority from U.S. Provisional Application for patent Ser. No. 61/051,171, filed May 7, 2008, the text of which is hereby incorporated by reference as though fully set forth herein.

FIELD AND BACKGROUND OF THE INVENTION

The present invention relates to the field of power generation and industrial boiler design, including boilers or steam generators used in the production of steam used to generate electricity. In particular, the present invention provides a new and useful method for erection of a solar receiver and support tower in an economical, efficient manner.

A solar receiver is a primary component of a solar energy generation system whereby sunlight is used as a heat source for the production of high quality steam that is used to turn a turbine generator, and ultimately generate electricity. The receiver is permanently positioned on top of an elevated support tower that is strategically positioned in a field of heliostats, or mirrors, that collect rays of sunlight and reflect those rays back to target wall(s) in the receiver. The height of the solar receiver support tower is established by the arrangement of the heliostat field and the operation of the heliostats in that field.

Conventionally, the construction of the solar receiver and its support tower employs heavy lift crawler cranes for placement of support tower sections on the tower foundation, and for placement of the assembled solar receiver on the tower. Due to the weight of the solar receiver, and the height of the tower above grade, required heavy lift cranes are, of necessity, very high capacity. High capacity mobile lift cranes are of limited availability, are high cost, and must operate on prepared ground capable of withstanding relatively high imposed bearing pressures. Because of their overall size, even though these heavy lift cranes are classified as mobile cranes, they are not readily repositioned between solar receiver placements in a typical solar energy generation installation. Transportation between operating positions at each receiver support tower requires assembly/disassembly/re-assembly of the heavy lift crane.

SUMMARY OF THE INVENTION

The present invention eliminates the need for these heavy lift crawler cranes for erection of the solar receiver and its respective support tower.

The present invention provides an erection method for a solar receiver and support tower which employs a climbing assembly to raise the solar receiver to its final elevation by progressively jacking and installing support tower sections.

Accordingly, one aspect of the present invention is drawn to an erection method for a solar receiver and support tower comprising the steps of providing a climbing assembly on the support tower to raise the solar receiver to its final elevation by progressively jacking and installing support tower sections to erect the tower and support the solar receiver.

Another aspect of the present invention is drawn to a method for erecting a solar receiver and support tower therefor, the method comprising the steps of: (a) providing a solar receiver; (b) providing a support tower in the form of two of more support tower insert sections and wherein at least one of the support tower insert sections is designed to finally receive and support the solar receiver; (c) providing a climbing assembly, wherein the climbing assembly is designed to raise the solar receiver to a final height by progressively jacking and installing support tower insert sections between a first support tower insert section and the bottom of the solar receiver; (d) placing the solar receiver on top of the first support tower insert section; and (e) progressively jacking and installing one or more additional support tower insert sections between the first support tower insert section and the bottom of the solar receiver.

Yet another aspect of the present invention is drawn to a method for erecting a solar receiver and support tower therefor, the method comprising the steps of: (i) providing a solar receiver; (ii) providing a monorail secured adjacent the solar receiver; (iii) providing a support tower, wherein the support tower comprises two or more support tower insert sections and wherein at least one of the support tower insert sections is designed to finally receive and support the solar receiver; (iv) providing a hydraulic climbing assembly, wherein the hydraulic climbing assembly is designed to raise the solar receiver to a final height by progressively jacking and installing support tower insert sections between a first support tower insert section and the bottom of the solar receiver; (v) placing the solar receiver on top of the first support tower insert section; and (vi) progressively jacking and installing support tower insert sections between a first support tower insert section and the bottom of the solar receiver.

Still another aspect of the present invention is drawn to a method for erecting a solar receiver and support tower therefore, the method comprising the steps of: (A) providing a solar receiver; (B) providing a monorail secured adjacent the solar receiver (C) providing a support tower, wherein the support tower comprises two or more support tower insert sections and wherein at least one of the support tower insert sections is designed to finally receive and support the solar receiver; (D) providing a hydraulic climbing assembly, wherein the climbing assembly is designed to completely encompass the at least one of the support tower insert sections and wherein the hydraulic climbing assembly is designed to raise the solar receiver to a final height by progressively jacking and installing support tower insert sections between a first support tower insert section and the bottom of the solar receiver; (E) placing the solar receiver on top of the first support tower insert section; and (F) progressively jacking and installing support tower insert sections between a first support tower insert section and the bottom of the solar receiver.

In all of these aspects, the last Step in each of these methods is repeated until a desired number of support tower insert sections have been installed.

The various features of novelty which characterize the invention are pointed out with particularity in the claims annexed to and forming a part of this disclosure. For a better understanding of the invention, its operating advantages and the specific benefits attained by its uses, reference is made to the accompanying drawings and descriptive matter in which preferred embodiments of the invention are illustrated.

DESCRIPTION OF THE PREFERRED EMBODIMENTS

Figure 2:
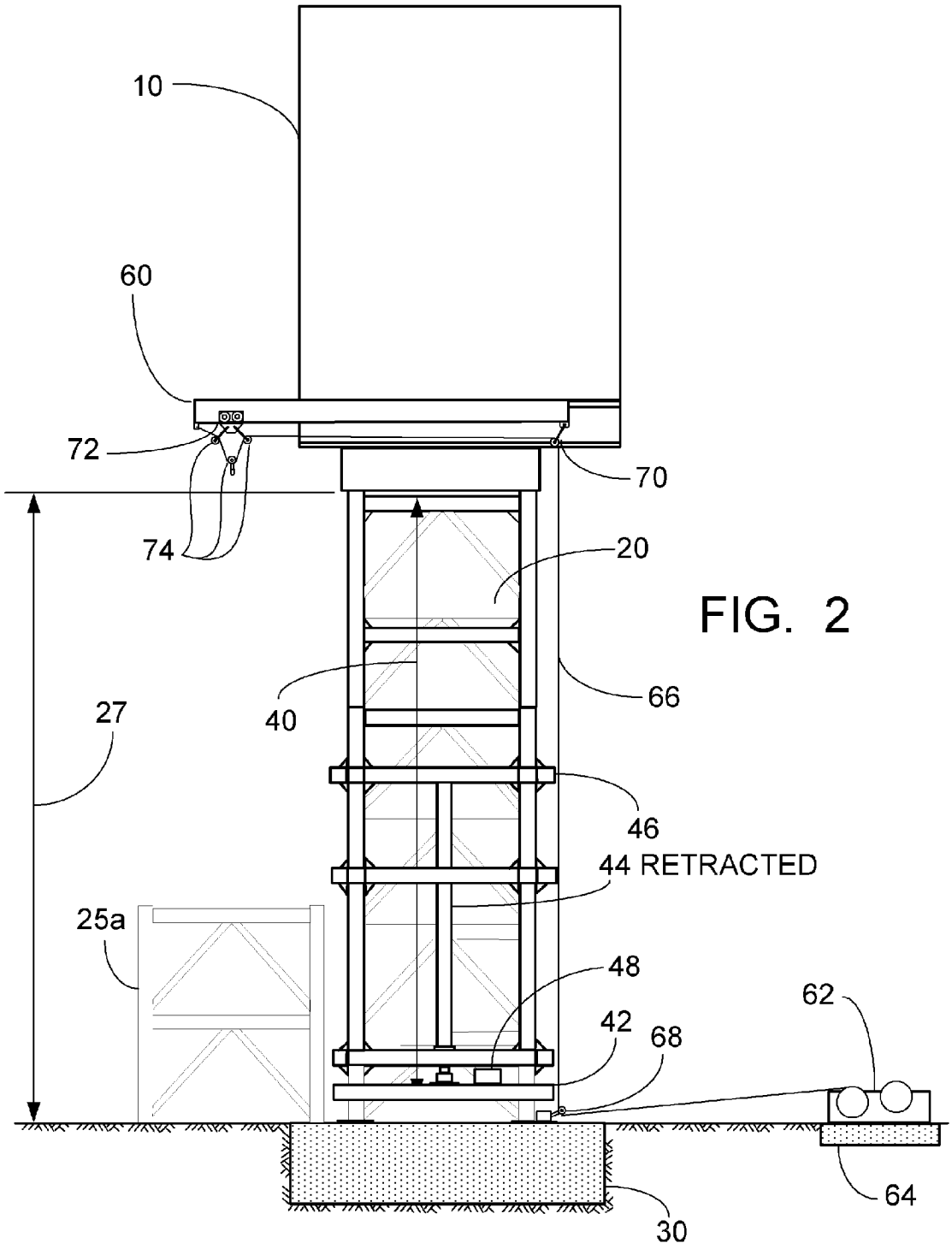
FIG. 2 is a schematic illustration of a subsequent step of the erection method according to the present invention, wherein a support tower insert section has been placed adjacent the tower.

Referring to the drawings generally, wherein like reference numerals designate the same or functionally similar elements throughout the several drawings, and to FIG. 2 in particular, there is shown a schematic illustration of the equipment involved in the method for erection of a solar receiver and support tower according to the present invention.

The method involves the use of a climbing assembly 40 to raise a solar receiver 10 to its final elevation by progressively jacking and installing support tower insert sections 25. As shown on FIG. 2, climbing assembly 40 comprises a collar assembly 42, hydraulic cylinders 44, and a climber mechanism 46 which are all adapted into the design of support tower 20. Climbing assembly 40 completely encompasses the periphery of support tower 20 framing members, such that the inside dimensions of climbing assembly 40 are approximately equal to the outside dimensions of support tower 20. Collar assembly 42 is affixed to the framing members in place on four sides of tower 20, and forms the base that supports two hydraulic cylinders 44 positioned on opposite sides of support tower 20. Hydraulic cylinders 44 are connected to climber mechanism 46 on two sides. Climber mechanism 46 is a structural framework that surrounds support tower 20 on four sides so as to be guided and stabilized by support tower 20 during a climbing operation. When hydraulic cylinders 44 are extended, the hydraulic cylinder sides of climber mechanism 46 are of a height that allows for installation of a support tower insert section 25 through the sides of climber mechanism 46 perpendicular to the hydraulic cylinder sides. In the Figs., the first support tower insert section is designated 25*a*, the second 25*b*, the third 25*c*, etc. Although not illustrated in the Figs., each support tower insert section 25 is also provided with shop-fabricated stairs and landings to provide ready access over the height of the support tower 20. The load of solar receiver 10 is assumed on the cylinder sides of climber mechanism 46, transferred to the hydraulic cylinders 44, and withstood by collar assembly 42 until the next support tower insert section 25 is installed. Hydraulic cylinders 44 are powered by a hydraulic control unit 48 placed on a platform in support tower 20 in close proximity to cylinders 44.

The method of erection using climbing assembly 40 is described on FIGS. 1 through 8 and as set forth in the following paragraphs.

Figure 1:
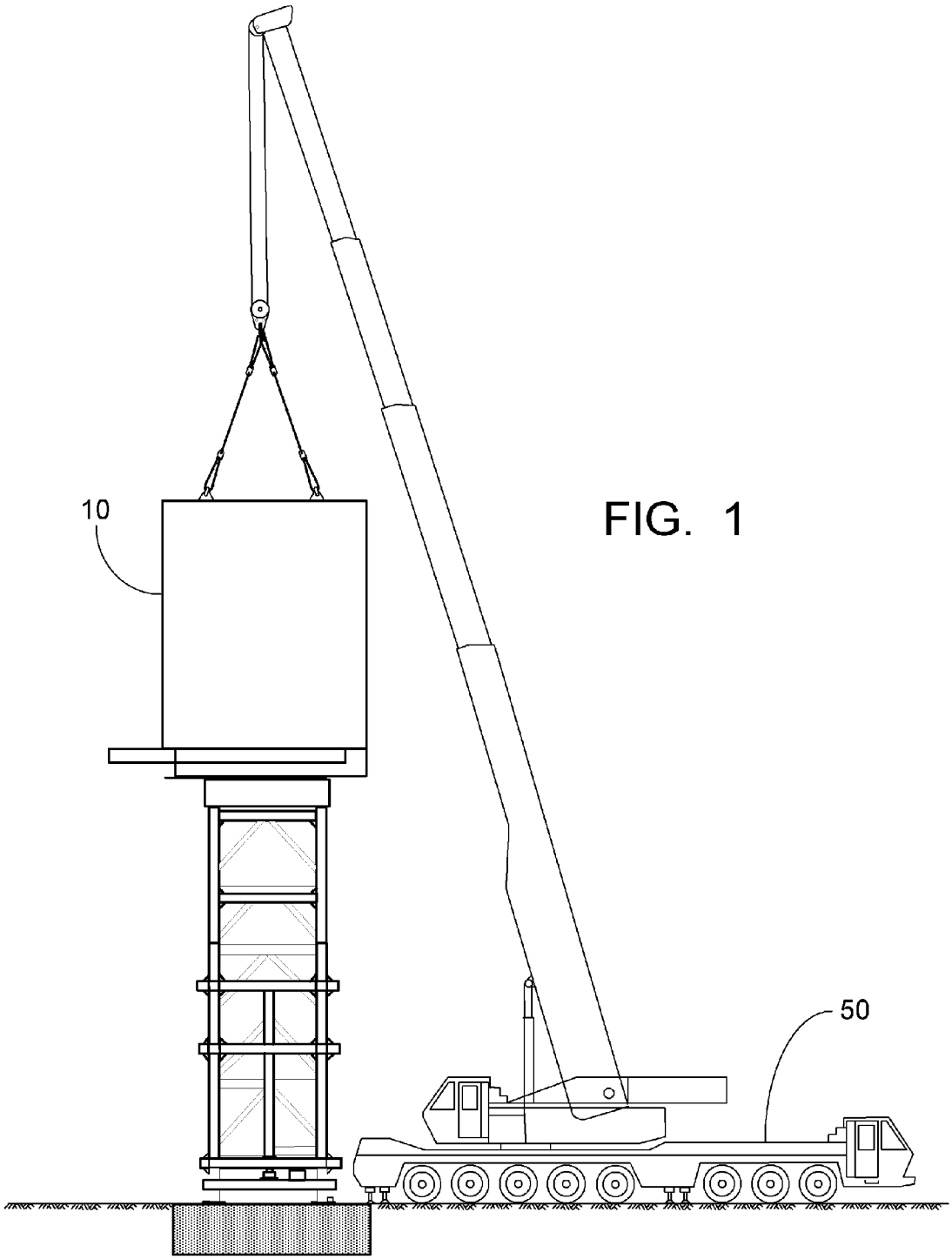
FIG. 1 is a schematic illustration of a first step of the erection method according to the present invention, wherein a hydraulic crane is used for initial load handling operations.

As shown in FIG. 1, which is a schematic illustration of a first step of the erection method according to the present invention, hydraulic crane 50 is used for initial load handling operations at the start of construction. In comparison to the heavy lift crane required for placement of a solar receiver 10 on top of the completed support tower 20, hydraulic crane 50 is much smaller in dimension and capacity, more available, less costly and much more practical and expedient.

As shown in FIG. 2, which is a schematic illustration of a subsequent step of the erection method according to the present invention, a support tower insert section 25*a* has been placed adjacent the tower 20. Following completion of a suitable tower foundation 30 and receipt of confirmation that the 28 day compressive strength of the foundation concrete has been attained, installation of the solar receiver support tower 20 begins via a method described herein. Via the use of a hydraulic crane 50, a base tower section 27 is erected, leveled, aligned and plumbed on foundation 30. Base tower section 27 is secured in a final position by tightening the base connection to anchor rods embedded in the concrete that forms foundation 30. Next, climbing assembly 40 is installed on base tower section 27.

The height of base tower section 27 is not limited to any one specific height. Rather, base tower section 27 is designed to have the height needed to receive the combined length of climber mechanism 46, collar assembly 42 and the retracted length of hydraulic cylinders 44.

As tower foundation 30 is being constructed and base tower section 27 is being installed, the individual shipping components of solar receiver 10 can be ground assembled into a complete unit for lifting to final position after base tower section 27 is erected. If solar receiver 10 is already a substantially complete unit as-delivered from the manufacturing facility, solar receiver 10 can be lifted into place on top of base tower section 27, after base tower section 27 is erected.

A monorail 60 is incorporated into the support framing, secured adjacent to solar receiver 10, advantageously at the base of solar receiver 10, and cantilevers a distance approximately half the plan dimension of support tower 20. This arrangement permits support tower insert sections 25*a*, 25*b*, 25*c*, etc. to be raised to elevation immediately outboard of tower 20 in place. In one embodiment, monorail 60 is sized to provide lifting capacity equal to the rigging weight of support tower insert sections 25 above base tower section 27. The hoisting mechanism provided for monorail 60 is powered by a base mounted two drum waterfall hoist 62 secured on a reinforced concrete foundation slab 64 near the base of solar receiver support tower 20. Load lines 66 extend over the fair lead distance from the hoist to lead sheaves 68 mounted on the base of tower 20, are routed up the outside of tower 20 to sheaves 70 attached to the end of monorail 60, and finally routed along monorail 60 to fit to trolleys 72 and load blocks 74 operating on monorail 60. These load lines 66 are used to raise and/or lower the load and to position the trolleys along the length of monorail 60.

Figure 3:
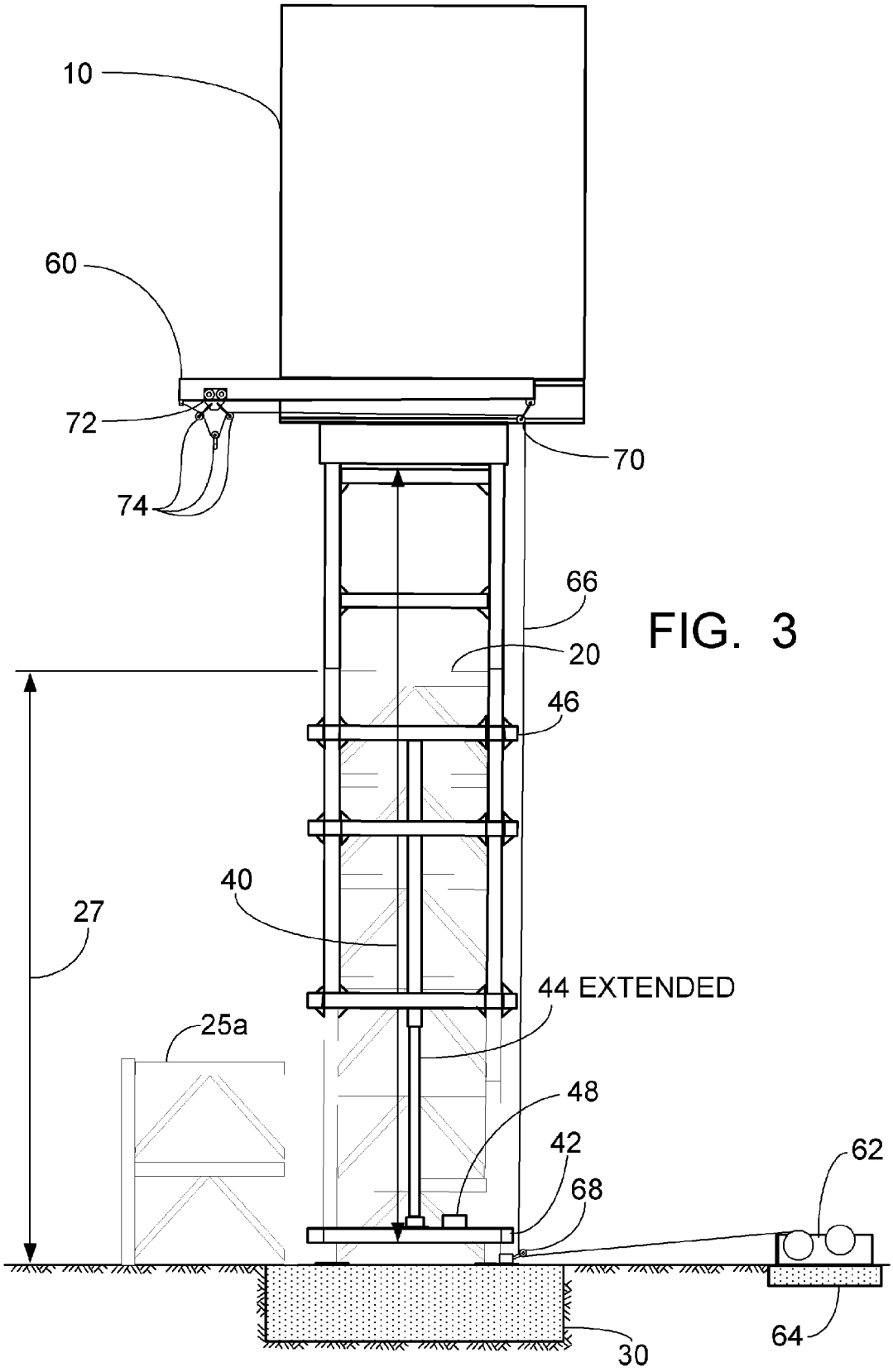
FIG. 3 is a schematic illustration of a subsequent step of the erection method according to the present invention, after the first climbing sequence has taken place.
Figure 4:
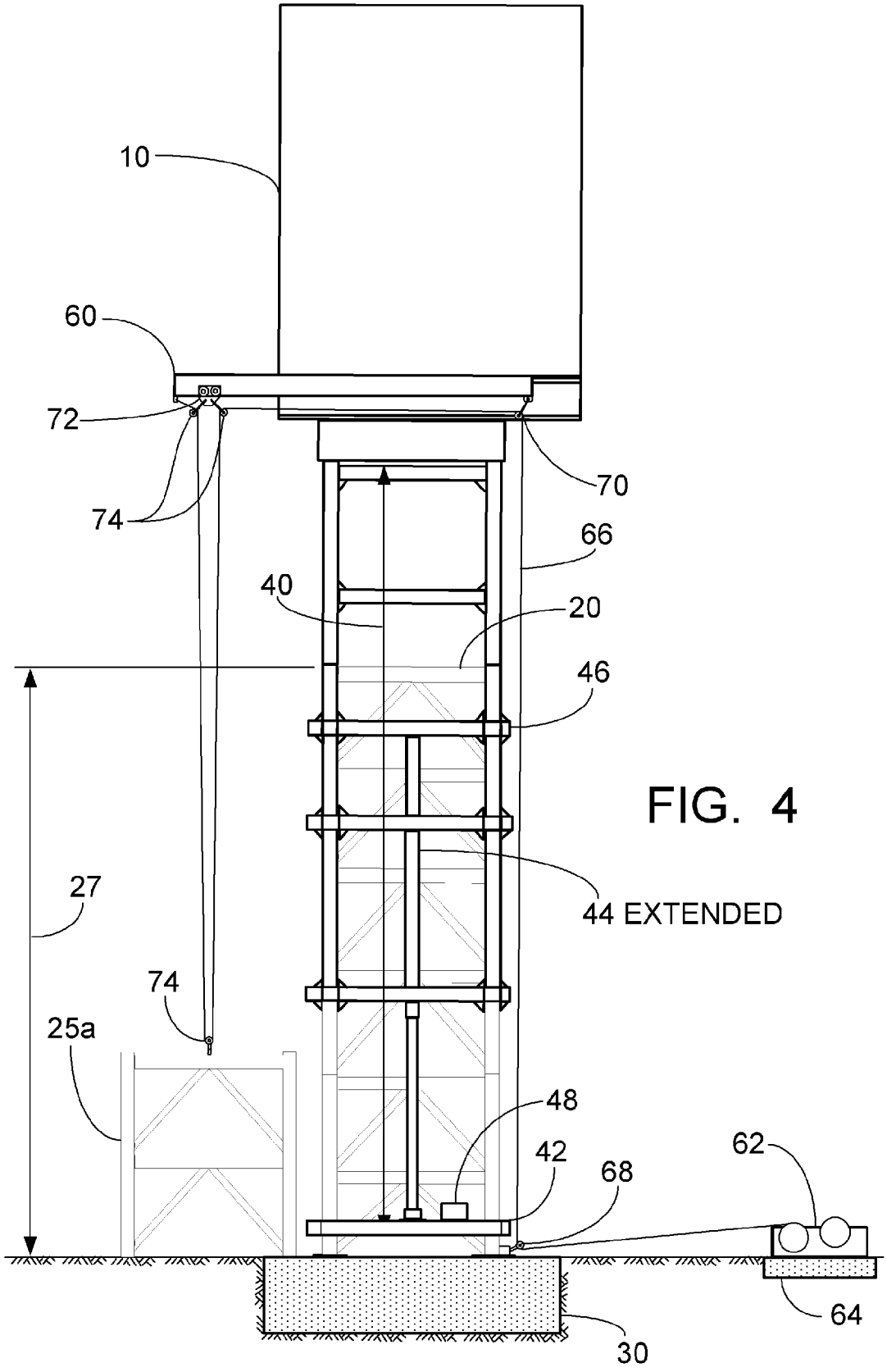
FIG. 4 is a schematic illustration of a subsequent step of the erection method according to the present invention, after the first climbing sequence has taken place, and wherein a support tower insert section is ready to be lifted.
Figure 5:
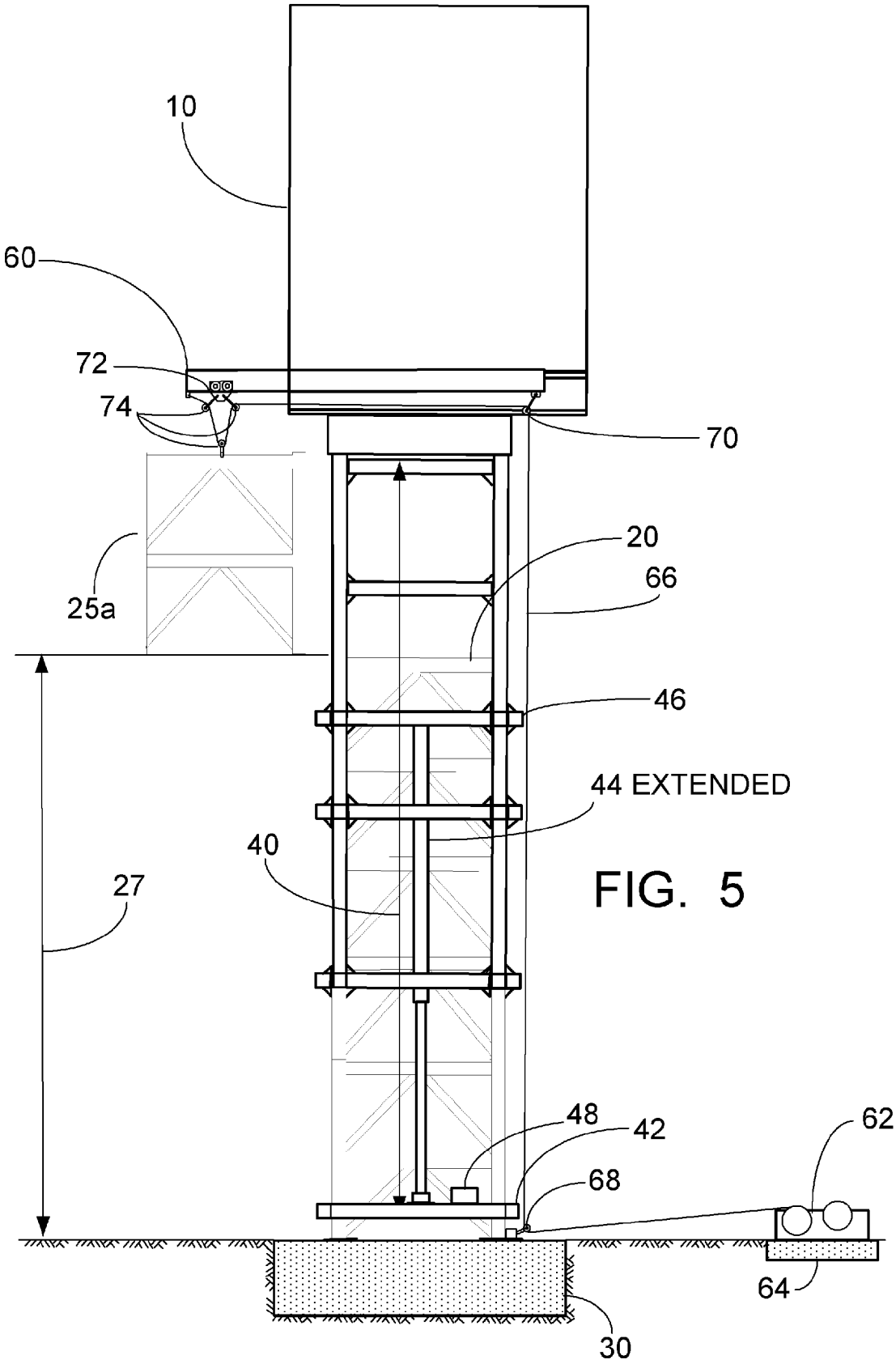
FIG. 5 is a schematic illustration of a subsequent step of the erection method according to the present invention, wherein a support tower insert section has been lifted to an upper portion of the support tower.
Figure 6:
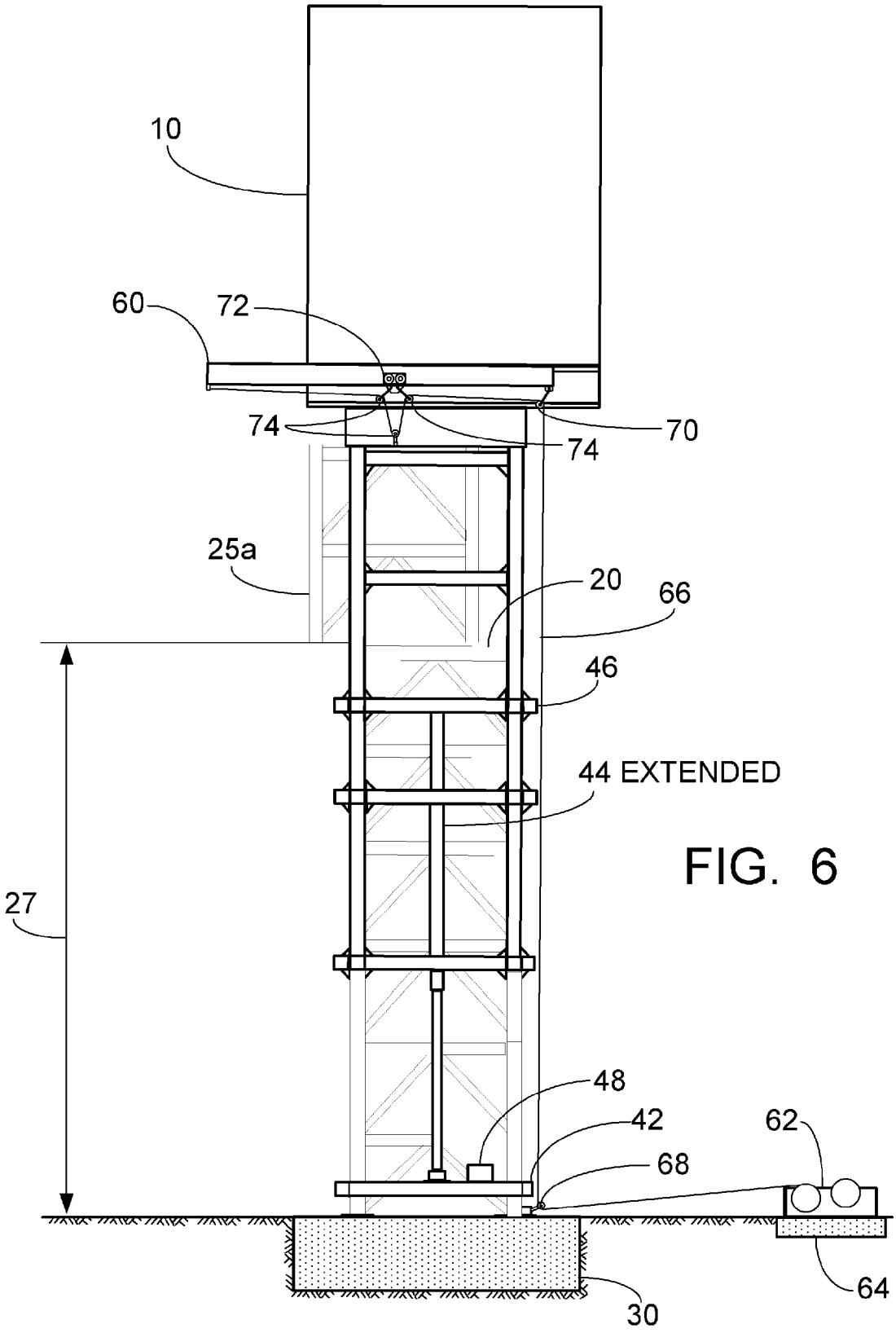
FIG. 6 is a schematic illustration of a subsequent step of the erection method according to the present invention, wherein a support tower insert section is in the process of being inserted into an upper portion of the support tower.
Figure 7:
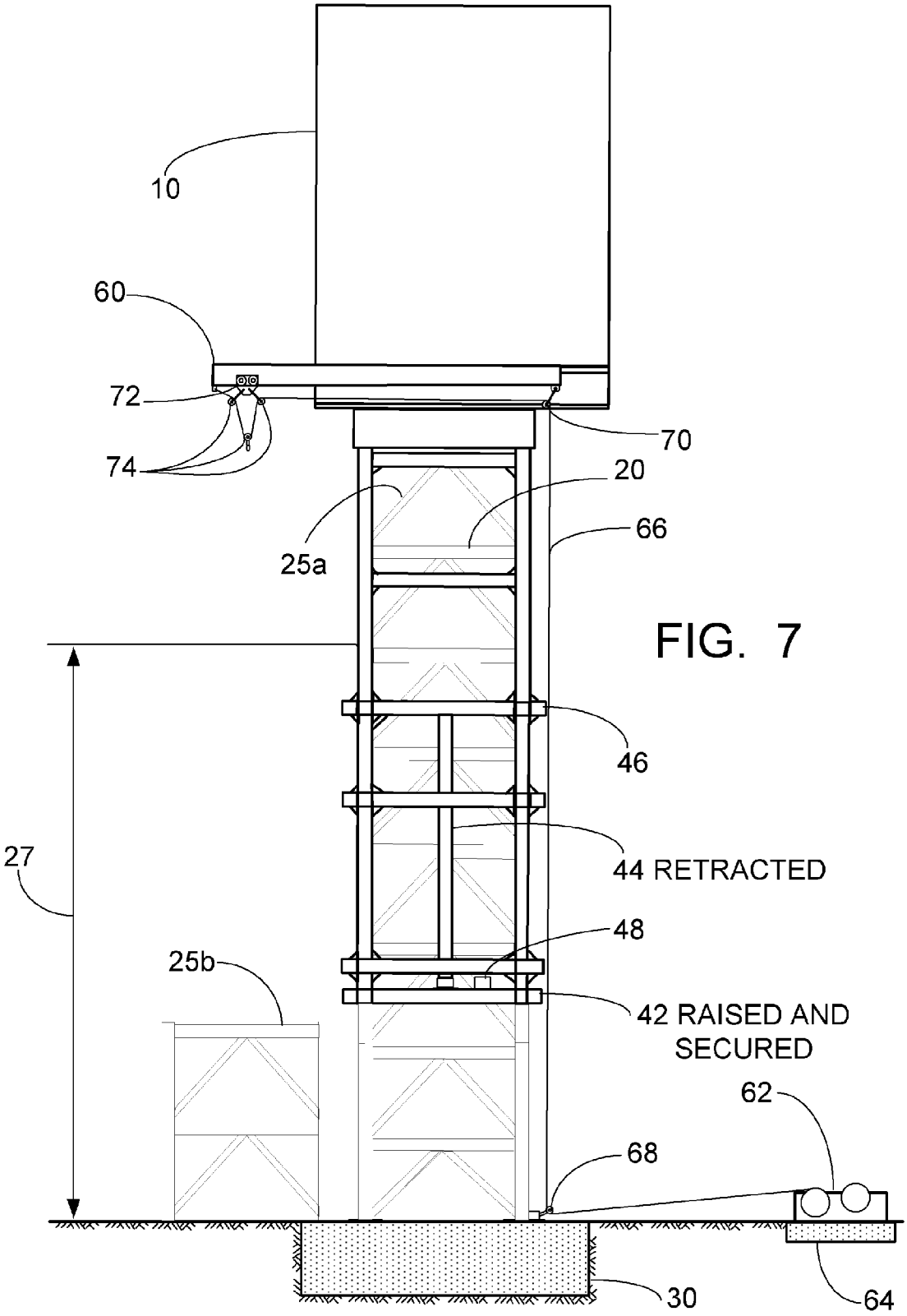
FIG. 7 is a schematic illustration of a subsequent step of the erection method according to the present invention, illustrating the repositioned climbing assembly after the first climbing sequence has taken place.

Refer now to FIGS. 3, 4, 5, 6 and 7. Once installation of base tower section 27 and climbing assembly 40 is completed, and solar receiver 10 with monorail 60 is in place, the first climbing sequence begins. With collar assembly 42 secured to base tower section 27, and climber mechanism 46 secured to solar receiver 10, hydraulic cylinders 44 extend to the length required to permit installation of the next support tower insert section 25. FIG. 3. Support tower insert section 25*a* is positioned on the ground adjacent to base tower section 27 in place, and beneath the hoisting hook on monorail 60. FIG. 4. The hoisting hook is attached to support tower insert section 25*a*, and section 25*a* is raised to an elevation just above the portion of base tower section 27 that is in place. FIG. 5. Once at the desired elevation, support tower insert section 25*a* is trolleyed into position over base tower section 27 in place. FIG. 6. Next, mating surfaces on base tower section 27 and support tower insert section 25*a* are brought into contact and securely connected. Collar assembly 42 is disconnected from the tower framing, and is raised to its next upper point of securement as hydraulic cylinders 44 retract. FIG. 7. At the retracted position of hydraulic cylinders 44, collar assembly 42 is reattached to the support tower framing, and the first climbing sequence is completed.

Figure 8:
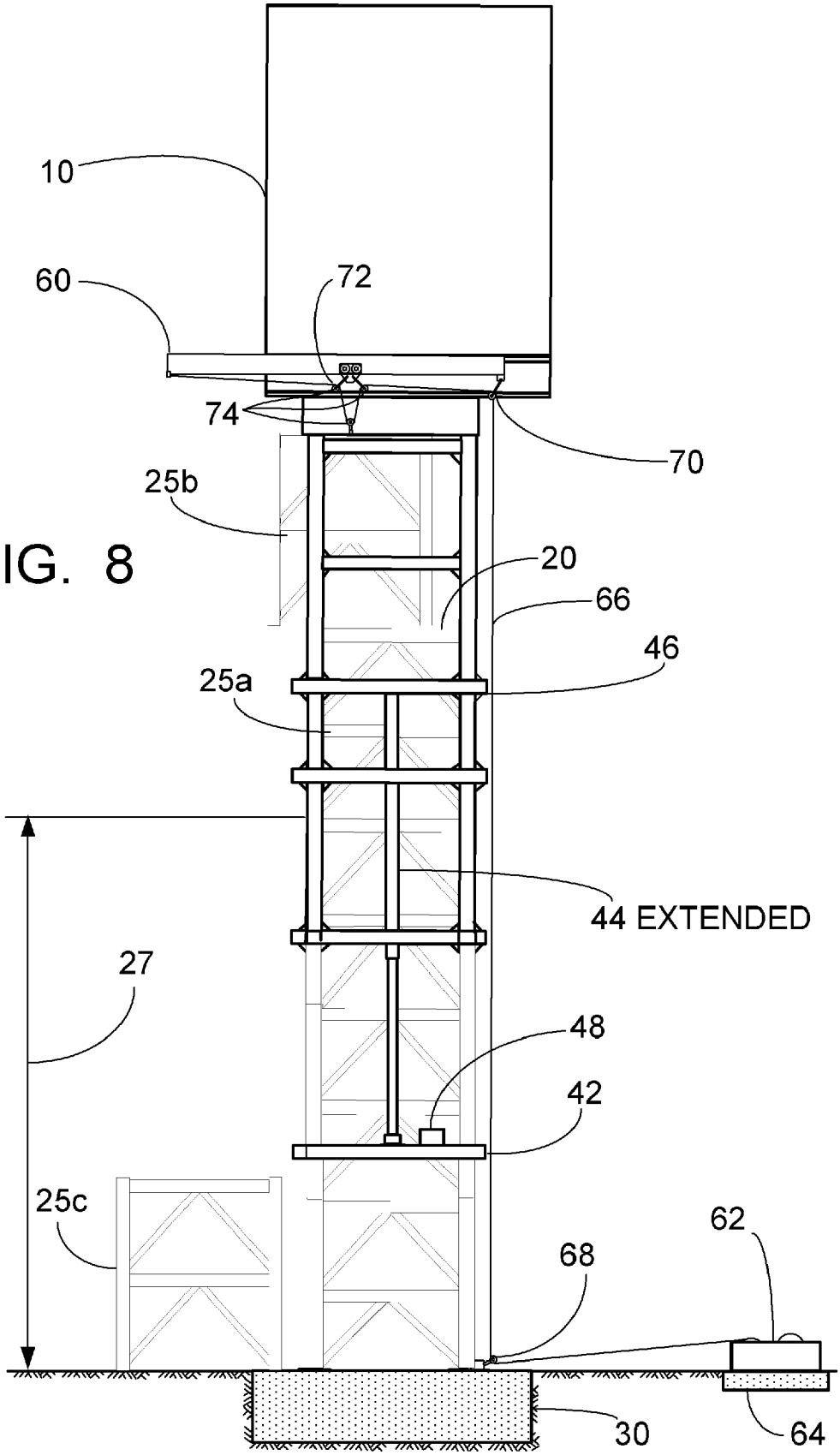
FIG. 8 is a schematic illustration of a subsequent step of the erection method according to the present invention, wherein a second support tower insert section is in the process of being inserted into an upper portion of the support tower.

The second climbing sequence duplicates the first, as do all remaining sequences until all support tower insert sections 25*b*, 25*c*, etc. are in place and solar receiver 10 is at its final elevation. FIG. 8.

Upon attachment of solar receiver 10 to the topmost support tower insert section 25 and completion of support tower 20 erection, climbing assembly 40 is brought to the ground by reversing the sequence of climbing operations. Climber mechanism 46 is secured to support tower 20 and detached from solar receiver 10. Collar assembly 42 is detached from support tower 20's framing and is suspended from hydraulic cylinders 44. Hydraulic cylinders 44 extend and lower collar assembly 42 to its next lower point of securement. Collar assembly 42 is reattached to support tower 20's framing and climber mechanism 46 is detached from support tower 20. Hydraulic cylinders 44 retract and lower climber mechanism 46 to its next lower point of securement to the support tower framing. Climber mechanism 46 is resecured, collar assembly 42 is detached, and the next lowering sequence proceeds in similar manner. Lowering sequences continue until climbing assembly 40 reaches its lowest position on support tower 20. At this lowest position, climbing assembly 40 is disassembled via use of hydraulic crane 50.

In conjunction with the assembly and/or erection of solar receiver 10 and support tower 20, feed water and high pressure steam piping (not shown) are appropriately routed up support tower 20 (e.g., on a side or sides of support tower 20). In one embodiment, the piping is constructed via the use of monorail 60 and the hoisting mechanism.

In one embodiment, monorail 60 can be left in place. Alternatively, monorail 60 can be removed. The hoisting mechanism, including hoist 62 at grade, lead sheaves 68, 70, trolleys 72 and load blocks 74, can or cannot be left in place per the discretion of the owner.

The advantages of the invention are many, and include:

1. The invention provides a safe, economical, efficient and practical means of erection of solar receivers and support towers.
2. The invention provides a means of erection of solar receivers and support towers that is independent of specific site constraints and restrictions.
3. The invention eliminates the need for high capacity, high cost, and limited availability heavy lift cranes for the erection of solar receivers and support towers.
4. The invention eliminates the need for project ground improvement for the placement of heavy lift cranes for the erection of solar receivers and support towers.
5. The invention uses the existing permanent construction of the solar receiver and support tower as the erection means for the solar receiver and support tower, and minimizes the need for any temporary installations.
6. The invention provides a means of solar receiver and support tower erection via the climbing assembly that is readily truck shippable to any site, with a minimum number of shipments.
7. The invention provides a means of completing solar receiver and support tower erection whereby critical rigging, handling and welding operations are performed at or near ground elevation.
8. The invention provides an integral means for installation of critical feed water and high pressure steam piping.
9. The invention provides a means of readily lowering and/or raising the solar receiver for any possible future maintenance operations.
10. With some adaptation of the climbing assembly to suit the cross sectional dimensions of the support tower, the invention provides a means of erection of solar receivers and support towers of unlimited height.
11. The invention offers a "green benefit". In order to get permits for construction in the state of California, for example, a heavy equipment list must be submitted for evaluation with regard to pollutant emissions. Eliminating the need for heavy lift crawler cranes reduces construction pollutant emissions and enhances the prospect for a favorable project evaluation with respect to this aspect.

It will thus be readily appreciated that the present invention overcomes the difficulties and reduces the cost and time required to erect a solar receiver and its support tower with conventional erection techniques which require expensive, heavy lift crawler cranes for placement of support tower assemblies on the tower foundation, and for placement of the assembled solar receiver on the tower.

While the principles of the present invention may be particularly applicable to new solar receiver installations, it will be appreciated that the present invention may be applied to construction involving the replacement, repair or modification of existing solar receivers. In some embodiments of the invention, certain features of the invention may sometimes be used to advantage without a corresponding use of the other features. Accordingly, while specific embodiments of the present invention have been shown and described in detail to illustrate the application and principles of the invention, it will be understood that it is not intended that the present invention be limited thereto and that the invention may be embodied otherwise without departing from such principles. All such changes and embodiments properly fall within the scope of the following claims.

We claim:

1. A method for erecting a solar receiver and support tower therefore, the method comprising the steps of:

(A) providing a solar receiver;

(B) providing a support tower;

(C) surrounding the support tower with a hydraulic climbing assembly, wherein the climbing assembly comprises:

(i) a collar assembly;

(ii) a climber mechanism located above the collar assembly; and (iii) a plurality of hydraulic cylinders connecting the collar assembly to the climber mechanism;

(D) securing the collar assembly to the support tower;

(E) securing the climber mechanism to the solar receiver;

(F) extending the hydraulic cylinders to raise the climber mechanism;

(G) inserting a support tower insert section between the support tower and the bottom of the solar receiver to increase the height of the support tower;

(H) placing the solar receiver on top of the support tower (I) disconnecting the collar assembly from the support tower;

(J) retracting the hydraulic cylinders to raise the collar assembly;

(K) securing the collar assembly to a next securement point on the support tower.

2. The method of claim 1, wherein the solar receiver is completely assembled prior to being placed on top of the climber mechanism.

3. The method of claim 1, wherein the solar receiver is assembled piece-meal on top of the climber mechanism.

4. The method of claim 1, wherein the climber mechanism comprises a lattice structure that is designed to permit the ingress of at least one support tower insert section into the interior thereof.

5. The method of claim 1, further comprising repeating Steps (E) through (K) until a desired number of support tower insert sections have been installed.

6. The method of claim 1, wherein a monorail is secured adjacent the solar receiver, the monorail being designed to insert the support tower insert section between the support tower and the bottom of the solar receiver.

* * * * *